United States Patent [19]

Hopkins

[11] 4,342,294

[45] Aug. 3, 1982

[54] ROTARY ENGINE VALVE WITH IMPROVED SEALS AND LUBRICATION SYSTEM

[75] Inventor: Phillip R. Hopkins, Hialeah, Fla.

[73] Assignee: Energy International Corporation, Miami Lakes, Fla.

[21] Appl. No.: 165,748

[22] Filed: Jul. 3, 1980

[51] Int. Cl.[3] ..... F01L 7/00

[52] U.S. Cl. ..... 123/190 E; 123/190 B; 123/190 BB; 123/190 DL

[58] Field of Search ..... 123/190 B, 190 BA, 190 BB, 123/190 R, 190 DL, 190 E, 190 A, 190 C, 190 CA, 41.4

[56] References Cited

U.S. PATENT DOCUMENTS

| | | | |
|---|---|---|---|
| 1,286,967 | 12/1918 | Eschwei | 123/190 A |
| 1,353,289 | 9/1920 | Stokes | 123/190 A |
| 1,513,911 | 11/1924 | Keller | 123/190 A |
| 1,902,069 | 3/1933 | Haller | 123/190 BB |
| 1,970,928 | 8/1934 | Wills | 123/190 BB |
| 1,971,060 | 8/1934 | Wills | 123/190 BB |
| 2,089,582 | 8/1937 | Seifert | 123/190 A |
| 2,183,024 | 12/1939 | Large | 123/190 A |
| 3,896,781 | 7/1975 | Smith | 123/190 A |
| 4,198,946 | 4/1980 | Rassey | 123/190 E |

FOREIGN PATENT DOCUMENTS

| | | | |
|---|---|---|---|
| 267794 | 3/1927 | United Kingdom | 123/190 A |
| 483726 | 7/1936 | United Kingdom . | |
| 456610 | 11/1936 | United Kingdom . | |
| 673560 | 6/1952 | United Kingdom . | |
| 966657 | 8/1964 | United Kingdom . | |
| 1496282 | 12/1977 | United Kingdom . | |

*Primary Examiner*—Ronald H. Lazarus

*Attorney, Agent, or Firm*—Herman J. Hohauser

[57] ABSTRACT

A shaft-type valve means for an internal combustion engine of the type having a block in which there is a cylinder and a piston reciprocal in the cylinder wherein the chamber is covered by a head and an improved valve is in the form of a shaft journaled in the head with a portion of the shaft spanning a portion of the cylinder above the piston and the shaft has a diametrical passageway of a cross sectional area which, in the direction of the centerline of the shaft, is at least as great as the radius of the cylinder and circumferentially is a distance substantially equal to one-sixteenth of the circumference of the shaft and wherein seal means are provided between the shaft and the engine and a crank shaft connected to the piston is connected to the shaft to rotate it simultaneously with the crank shaft by a force transmission means such as a belt or the like.

9 Claims, 9 Drawing Figures

ROTARY ENGINE VALVE WITH IMPROVED SEALS AND LUBRICATION SYSTEM

FIELD OF THE INVENTION

This invention relates to an improved valve means for an internal combustion engine.

BACKGROUND OF THE INVENTION

In the past there have been numerous types of valving arrangements for internal combustion engines. This invention is of a shaft-type valve wherein there are diametrical pasageways arranged in the shaft which spans the cylinder and through which intake and exhaust takes place and wherein the openings or holes in the shaft are of predetermined size and this size in the circumferential distance is substantially equal to 1/16 of the circumference of the shaft, as is set forth more fully hereinafter.

The rotary valve is different from prior art valves in that a direct travel of intake and exhaust is through the shaft which allows a continuous rotary motion of the shaft with correct timing for a four cycle piston engine. The timing is possible because the width circumferentially of the opening is substantially 1/16 of the circumference of the shaft. The problems of prior art rotary valves are primarily that they do not seal an explosive mixture and allow gas to escape. The shaft of the instant invention has both longitudinal and circular seals to prevent gas from escaping.

The advantages of the instant invention are the elimination of valve springs and popet type valves that currently require in the order of about 10% or more of the delivered or produced horse power of the engine. There is a direct and unobstructed intake and exhaust flow and no valve face in the path of the mixture as in current engines. The components are of a structure which permits them to be very strong and there is a reduction in the number of working parts by reason of the utilization of the instant invention. The system is adaptable for virtually all four cycles piston engines and is adapted to work well with fuel injection and stratified charge heads. It is also useful for diesel fuel where very high compression ratios are required. The shafts and seal of the instant invention replace a large number of parts, estimated to be in the range of about 80, which are normally utilized to accomplish the same effect in a normal V8 engine reducing the expense of such engines. Because of the rotary movement and because of the elimination of valve springs, the engine is capable of turning at increased rpm's with a resultant higher horse power from the same displacement. Also, when used with the stratified charge type engine, the rich charge chamber can be shaped more efficiently than with normal engines which yields a greater degree of horse power for less polluting gases since the same are combusted more thoroughly.

This invention provides for a shaft having improved seals and improved lubrication system for the shaft which serves as a rotary valve, and a wiper-type acting bar-type seals urged into engagement with the interior of the head but carried by the rotating shaft to provide for a smooth distribution of oil and sealing of the shaft valve as is set forth more fully hereinafter.

OBJECTS OF THE INVENTION

It is an object of this invention to provide a device of the type described hereinafter which is simple and inexpensive to manufacture, highly useful in operation, efficient, and calculated to reduce pollution.

In accordance with these and other objects which will become apparent hereinafter, the instant invention will now be described with reference to the accompanying drawings in which:

DESCRIPTION OF THE PREFERRED EMBODIMENT

Figure 1:
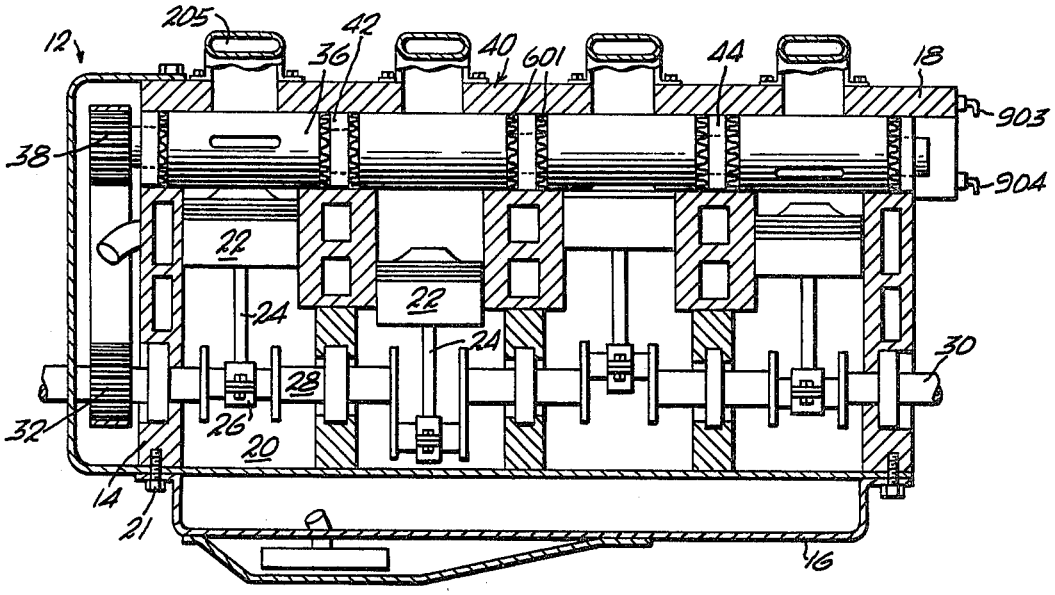
FIG. 1 is a side elevation view in cross section of an internal combustion engine of the four cycle type.

Referring to FIG. 1, there is shown an internal combustion engine generally designated by the numeral 12. It is composed of a block 14 having a lower end spanned by an oil pan 16 in open communication with the lower end of cylinders, such as that designated by the numeral 20 with the oil pan being secured to the block by suitable means, such as the bolt 21. The upper end of the block is provided with a head 18. Within the block, pistons 22 are reciprocal in the cylinder 20, for example, being connected by a rod, such as that designated by the numeral 24 to a crank shaft 28 as at 26, and, specifically, to an eccentric portion thereof. The end 30 of the crank shaft is connected by a suitable means to a power take-off and, at the other end, 32, a gear or other drive means is provided for engaging a belt, chain, or other type of force transmission means to the gear 38 on the end of a shaft 36 supported in spanning relation of the side of the upper end zone of the cylinders and being supported such as by bearings 42 and 44 captivated between the upper portion 40 of the head 18 and the block. With respect to FIG. 2, the shaft 36 is rotatable within a tunnel through the head, generally designated by the numeral 41 and wherein there is an opening on the opposite sides in diametrical relation as at 43 and 53. As is clearly shown in FIG. 2 in the preferred embodiment, the head is provided with a pair of coplanar surfaces 70 and 71 which abut the upper surface 73 of the block and are suitably secured thereto as by the bolts 75 and 77. The upper portion 40 of the head which spans the piston cylinders is elevated, as at 46 in the central longitudinally extending zone and curves downwardly and outwardly to the portions 70 and 71 on the block 73 as designated by the numerals 45 and 45' and through which the opening 43 is located in the case of the shaft 36. On the opposite side of the cylinder there is also an opening in the head as at 81 and a tunnel 83 is defined in the head and a shaft 37 is rotatable therein in a manner similar to that referred to above in connection with the shaft 36. Each of the shafts has a through bore as at 90 and 92 which is diametrical and extends completely across it and is of a diameter which is substantially one-sixteenth of the circumference of the shaft, one of which will be referred to as the intake shaft and one of which will be referred to as the output shaft. Through the central portion of the head a bore 101 is provided for a spark plug 50 which will be utilized to ignite a fuel mixture which will be introduced and exhausted into the chamber 103 in a manner which will now be described.

Figure 2:
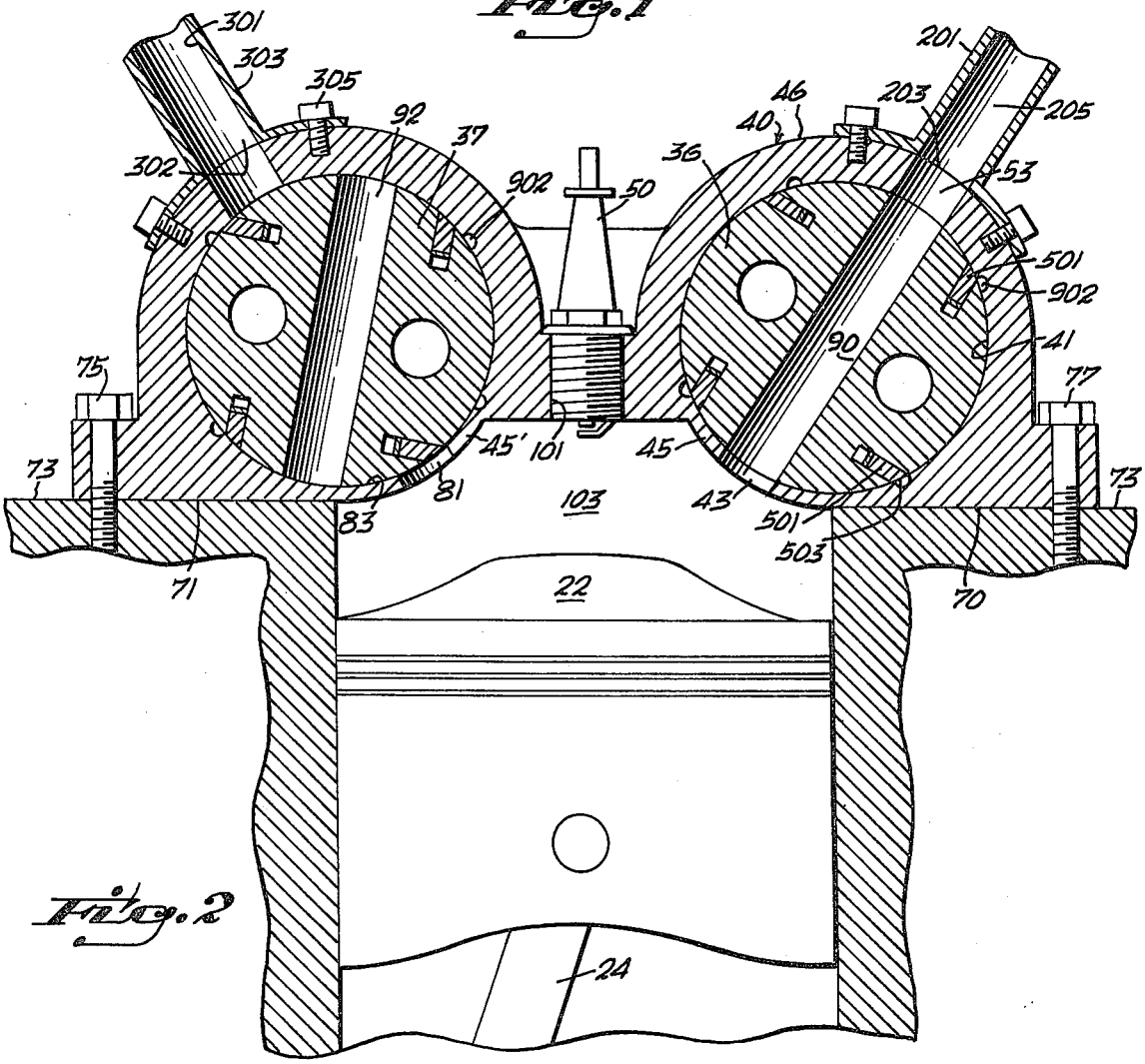
FIG. 2 is a partial view taken on the plane indicated by the line 2—2 of FIG. 1 and looking in the direction of the arrows.
Figure 3:
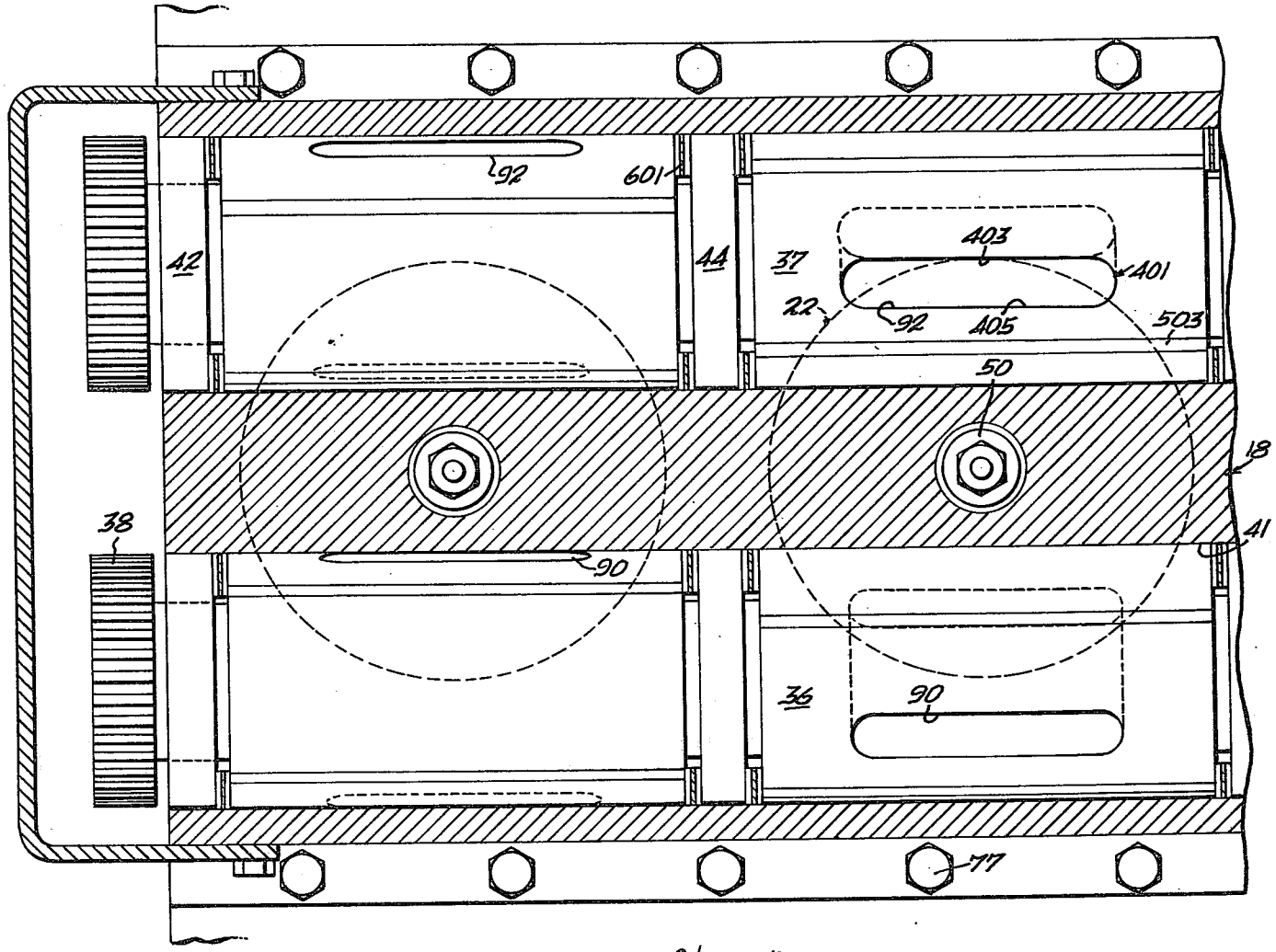
FIG. 3 is a plan view in cross section of the upper zone of FIG. 1.

Referring to the shaft 36, the one on the right in FIG. 2, this will be referred to as the intake shaft and it serves as an intake valve. A fuel and air mixture is introduced into the hood 201 having the opening 203 leading into the tunnel so that when fuel and air are introduced through the opening 205, and the shaft is lined up with the opening 53, fuel will pass through and out the opening 43 and into the chamber 103. As the shaft rotates, however, this passageway will be closed; and at that time a spark will be ignited as at 50 which will cause an explosion driving the piston 22 downwardly and, on its uptake stroke, the hole 92 in the shaft 37 will have rotated into alignment with the hole 302 in the hood 303 which is bolted as at 305 to the upper end of the head and the upwardly moving piston will cause the gases to exhaust through the opening 81 and diametrical passageway 92 through the shaft 37 to exit through the hole 301. Referring now to FIG. 3, it is seen that the passageways 90 and 92 of the cylinder 20 are elongated, that is, each has a substantial axially extending mouth to mate with the diametrical size of the cylinder.

Referring further to FIG. 3, and particularly to the opening designated by the numeral 401 for convenience, it is seen that this opening in the shaft is one-sixteenth of the circumference of the shafts 36 and 37, which are equal in the preferred embodiment, i.e., the distance between the relatively long sides 403 and 405, and these are sized to cover approximately 80% of the diameter of the cylinder and piston and preferably at least as great as the radius of the cylinder. This is true with respect to each of the diametrical passageways through the shafts comprising the rotary valves. Seal means are provided on each of the shafts. These seal means are of two types. As shown in FIG. 2, circumferential slots which extend in the chord direction, that is, non-diametrical are provided and in each there is received a seal member 501 comprising a bar having an outer surface 503 in engagement with the inner surface of the head at all times in rotation and this provides a sweeping action against the inner surface of the head providing seal means to prevent the passage of gas in the space located between the outer surfaces of the shafts 36 and 37 and the wall surfaces of tunnels 41 and 83 respectively, such passage of gas commonly referred to as blow by. Each bar is seen to have a longitudinal axis extending along the longitudinal axis of either of the shafts 36 or 37, each bar also having the usual geometrical transverse axis disposed normal to the longitudinal axis and located along the greatest width of the bar, that is, parallel in the present situation as shown to the planar, length-wise sides of the bar. The transverse axis of each of the bars thus is located along a line coincident with a chord of a circular section taken normal to the longitudinal axis of either of the shafts 36 or 37 as shown particularly in FIG. 2. Additional seal means are provided between each of the cylinders and between the bearings, as shown in FIG. 1, 42 and the enlarged portion of the shaft 36, this seal means being designated by the numeral 601 and resisting the passage of gas or blow by along the longitudinal axis of shafts 36 and 37. These seal means may resemble conventional piston rings and are seated in grooves located appropriately in the shafts.

Figure 4:
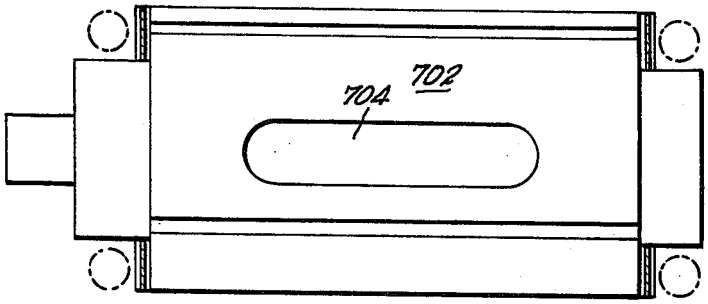
FIG. 4 is a shaft as described hereinafter for use in a one cylinder engine.
Figure 5:
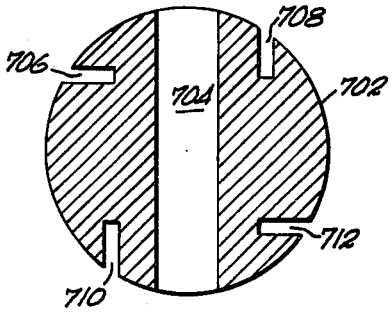
FIG. 5 is a view in cross section of the shaft taken on the plane indicated by the line 5—5 of FIG. 4.
Figure 6:
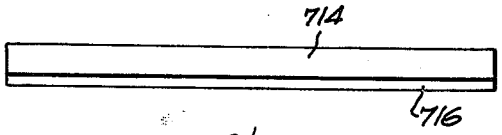
FIG. 6 is an elevation view of the bar seal 501 seen in the embodiment of FIG. 2.
Figure 7:
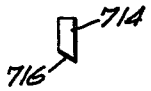
FIG. 7 is an end view of the bar seal of FIG. 6.
Figure 8:
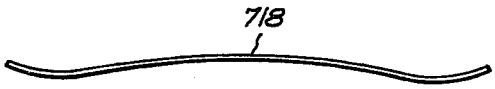
FIG. 8 is an elevation view of the leaf spring utilized to urge the bar seal outwardly.
Figure 9:
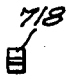
FIG. 9 is an end view of the spring shown in FIG. 8.

The embodiment of FIGS. 4 and 5 is of a device according to the above description and utilized in a one cylinder engine. New numbers will be assigned to follow the description of FIGS. 4 through 9. The shaft 702 has a diametrical through bore 704 and the peripherally spaced circumferential slots 706, 708, 710 and 712 which are arranged with respect to the radius at the angle shown in the drawings and which generally traces a depthwise chord as opposed to a radial line. A bar seal 714, shown in FIGS. 6 and 7, is sized to snugly seat in each of these recesses and is adapted to be urged outwardly by the spring shown in FIGS. 8 and 9. The bar seal has a beveled or wiper surface 716 adapted for windshield wiper engagement with the interior of the bore within which the shaft rotates. The bar is urged outwardly by a spring 718 which is in each of the recesses and urges the bar seated in it into sweeping engagement with the wall of the engine as it rotates and the seal is carried by the shaft. It is noted that the oil distribution means 902 shown in FIG. 2 is utilized to distribute oil along the length of the shaft.

In the preferred embodiment longitudinally extending passgeways are provided in the groove for lubrication between the exterior surface of the shaft and the interior surface of the tunnel through the head, as indicated by the numeral 902, which are suitably fed as by oil lines 903, 904.

This invention finds use in four cycle (Otto cycle) internal combustion engines.

Suitable openings, shown through the shafts, and in the engine block are provided for water cooling of the same.

What is claimed is:

1. In an engine having at least one rotary valve operatively associated with engine cylinders, the rotary valve being rotatable within an aperture formed in an engine head associated with the engine cylinders, and seal structure extending along the rotary valve for sealing that space located between wall surfaces of the aperture within which the valve rotates and outer surfaces of the rotary valve, the seal structure comprising at least four elongated seal members carried by said rotary valve each said seal member having a portion extending into said space to effect sealing against opposing surfaces, the improvement comprising the location of the transverse axis of each said seal member along a line coincident with a non-diametric chord of an axial cross-section of said rotary valve wherein said rotary valve is provided with at least four longitudinally extending, circumferentially spaced recesses extending into said rotary valve and opening into said space, the transverse axis of each of said recesses lying along a line coincident with a non-diametric chord of the cross-section of said rotary valve, each recess having an elongated seal member disposed therein with the portion of the seal member which extends into said space having a surface face which engages the wall surface of the aperture within which the valve rotates to effect sealing of said space and the line of each of said seal members coincident with the non-diametric chord of an axial cross-section of said rotary valve intersects the circumferentially spaced recess of a respective adjoining seal member.

2. In the engine of claim 1 wherein the surface face of each of said elongated seal members is shaped to increase the contact area between the seal member and the opposing wall surface of the aperture within which the valve rotates.

3. In the engine of claim 1 wherein the improvement further comprises spring means disposed in said recesses for urging said seal members outwardly of said valve.

4. In the engine of claim 1 wherein said engine is an internal combustion engine.

5. In the engine of claim 1 wherein the improvement further comprises means for distributing oil along the length of said rotary valve.

6. In the engine of claim 5 wherein said distributing means comprise at least one groove formed in the wall surface of the aperture and means for supplying oil to the groove.

7. In the engine of claim 1 wherein said recesses are regularly spaced about the periphery of said rotary valve.

8. In the engine of claim 7 wherein each said recess lies along a chord disposed at a given angle relative to a radius of the cross-section of said rotary valve drawn to a point of intersection of said chord with the periphery of said cross-section.

9. In the engine of claim 1 wherein said rotary valve comprises an elongated shaft.

* * * * *